United States Patent [19]

Torii et al.

[11] Patent Number: 5,064,806

[45] Date of Patent: Nov. 12, 1991

[54] THERMOSENSITIVE RECORDING MATERIALS

[75] Inventors: Takahiro Torii; Masahiro Miyauchi; Haruyoshi Funae; Tomonori Kiriyama, all of Takasago, Japan

[73] Assignee: Mitsubishi Paper Mills Limited, Tokyo, Japan

[21] Appl. No.: 372,811

[22] Filed: Jun. 29, 1989

[30] Foreign Application Priority Data

| | | | |
|---|---|---|---|
| Jun. 30, 1988 | [JP] | Japan | 63-164438 |
| Oct. 21, 1988 | [JP] | Japan | 63-266895 |
| Oct. 24, 1988 | [JP] | Japan | 63-268705 |

[51] Int. Cl.[5] ..... B41M 5/40

[52] U.S. Cl. ..... 503/200; 427/152; 503/226

[58] Field of Search ..... 427/150–152; 503/200, 226

[56] References Cited

FOREIGN PATENT DOCUMENTS

| | | | |
|---|---|---|---|
| 54-23545 | 2/1979 | Japan | 503/200 |
| 59-225987 | 12/1984 | Japan | 503/200 |
| 2001571 | 1/1987 | Japan | 503/200 |

*Primary Examiner*—Pamela R. Schwartz

*Attorney, Agent, or Firm*—Cushman, Darby & Cushman

[57] ABSTRACT

A thermosensitive recording material bearing a specific intermediate layer comprising a specific alkyl ammonium salt provides a high color density even with a low printing energy and minimized background strain. The intermediate layer is provided between a support and a thermosensitive recording layer.

6 Claims, No Drawings

THERMOSENSITIVE RECORDING MATERIALS

BACKGROUND OF THE INVENTION

1. Field of the Invention

The present invention relates to thermosensitive recording materials and more particularly, to improved thermosensitive recording materials utilizing a color forming reaction between electron donating dye precursors which are substantially colorless or light-colored at normal temperature and electron accepting compounds.

2. Related Art

Thermosensitive recording materials of two component color forming system comprising a substantially colorless or light-colored dye precursor (hereinafter referred to as a color former) and an electron accepting compound (hereinafter referred to as a color developer) involve primary color formation and have many advantages in that post treatment such as development or the like is unnecessary, handling is easy, etc. Therefore, the system has become the main trend of thermosensitive recording materials.

Thermosensitive recording materials have been widely used for facsimiles, recording labels for measuring instruments, etc. In particular, a growth in the field of facsimiles is remarkable in recent years and with the growth, quality demand in recording materials for facsimiles is becoming severe.

That is, as the speed of facsimiles increases, recording in a short pulse width, namely, color formation in a sufficient density even with a small heat energy but no color formation by heat from a thermal head after printing, is required. In addition, adhesion of thermal melt products (background stains) on a thermal head should also be reduced as less as possible.

To comply with the above requirements contradictory to each other, it has been proposed to provide, for example, an intermediate layer comprising inorganic powders having an oil absorbing amount of more than 50 ml/100 g disclosed in Japanese Patent Application Laid-Open No. 54-23545; a layer comprising an expanded filler obtained by expanding an expandable plastic filler disclosed in Japanese Patent Application Laid-Open No. 59-225987; etc.

However, in the case of using thermosensitive recording materials for forming a color with a low heat energy, adherence of thermal melt to a thermal head tends to be increased. Where printing is made over long periods of time, printed matters become unclear due to head stains and printing fails sometimes in a serious case. Further where the quality associated with generation of stain is good, a decrease in density is large because of permeation of thermal melt when printed with a higher energy.

SUMMARY OF THE INVENTION

An object of the present invention is to provide thermosensitive recording materials having high sensitivity, minimized adherence of stains to a head and a minimized reduction in density when printed with a high energy.

As a result of extensive investigations, the present inventors have discovered that by incorporating into an intermediate layer provided between a support and a thermosensitive recording layer at least one selected from the group consisting of:

a compound represented by general formula [I] below, or a substance produced from at least one of clay, calcium carbonate and silica, a bentonite pigment and an alkyl ammonium salt represented by general formula [I], a combination of an oil-absorbing white pigment with a condensation product of an aromatic aldehyde and a polyvalent alcohol of at least 5 valencies, and, an N-acylamino acid compound, thermosensitive recording materials having high sensitivity, free of stains even with a high heat energy and having a minimized reduction in color density can be obtained.

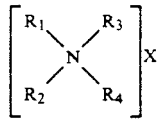

[I]

wherein each of $R_1$, $R_2$, $R_3$ and $R_4$ independently represents hydrogen or an alkyl group, provided that the sum of carbon atoms for $R_1$ to $R_4$ is at least 14; and X represents an anionic atom or atomic group.

DETAILED DESCRIPTION OF THE PREFERRED EMBODIMENTS

The compound of formula [I] is described in more detail.

Examples of X are $CO_3^{--}$, $NO_3^-$, etc.

Turning firstly to the alkyl ammoniun salt, specific examples of the alkyl ammonium salt include: dimethyldistearylammonium chloride, dimethyldicetylammonium chloride, dimethyldicerylammonium chloride, dimethyldihexylammonium chloride, dimethyldilaurylammonium bromide, dimethyloctadecylammonium bromide, cetyldimethylethylammonium chloride, dilaurylammonium chloride, dimethyldistearylammonium carbonate, etc.

These alkyl ammonium salts may also be used as admixture of two or more. An amount of the alkyl ammonium salt to be used is not critical. Preferably, the alkyl ammonium salt is coated onto a support in a solid content of 0.05 to 6 g/m$^2$ when calculated as the alkyl ammonium salt.

Turning secondly to the oil-absrobing white pigment, specific examples of the white pigment include calcined kaolin, natural silica, synthetic silica, silica-alumina, calcium carbonate, calcium oxide, magnesium carbonate, magnesium oxide, magnesium hydroxide, etc. Of these, calcined kaolin, natural silica, synthetic silica and silica-alumina are preferably used since they have a particularly high oil-absorbing property.

As the condensation products of aromatic aldehydes and polyvalent alcohols of 5 or more valencies which can be used in combination with the white pigments above, mention may be made of so-called gelling agents described in, for example, Japanese Patent Publication No. 51-48465, Japanese Patent Application Laid-Open No. 54-33533, etc.

Examples of the polyvalent alcohol of 5 or more valencies are arabitol, xylitol, sorbitol, mannitol, etc.

Examples of the aromatic aldehyde include benzaldehyde and a nucleus-substituted benzaldehyde, etc. As the substituent, mention may be made of, for example, an alkyl group, an alkoxy group, hydroxyl group, a halogen and a combination of two or more of them.

Turning thirdly to the N-acylamino acid compound there are, N-acylamino acid esters, N-acylamino acid amides and N-acylamino acid salts, which are exemplified by so-called amino acid type gelling agents disclosed in, for example, Japanese Patent Publication No. 53-13434. In more detail, the following compounds can be exemplified.

(1) N-caproylglycinestearylamide
(2) $N^2$,$N^6$-dicaproyllysinelaurylamide
(3) dilauryl N-lauroylglutamate
(4) $N^{\alpha}$,$N^{\omega}$-dicaproyllysinestearylamine salt
(5) N-lauroylglutamic dilaurylamide
(6) N-lauroylglutamic dibutylamide
(7) N-caproylglutamic dilaurylamide
(8) N-lauroylglutamic stearylamide
(9) $N^{\alpha}$,$N^{\omega}$-dicaproyllysinelauryl ester
(10) $N^{\alpha}$,$N^{\omega}$-distearoyllysineoctyl ester
(11) N-stearoylglycinelaurylamide
(12) lauryl N-palmitoyl-ε-aminocaproate
(13) $N^{\alpha}$,$N^{\omega}$-dicapryloyllysinestearylamine salt
(14) $N^{\alpha}$,$N^{\omega}$-dilauroyllysinestearylamine salt
(15) N-lauroylvalinelaurylamine salt
(16) dioctyl N-lauroylglutamate
(17) N-lauroylphenylalaninelaurylamide etc. The starting N-acylamino acid and the alcohol or amine can be used in various combinations. In addition to the single use, it is also effective to incorporate the compounds as admixture thereof.

A proportion of the alkyl ammoniun salt or the substance of the present invention which is produced from the alkyl ammoniun salt, etc. in the intermediate layer is generally in the range of 0.5 to 90% by weight, preferably 1 to 50% by weight, as a solid content.

The alkyl ammoniun salt of the present invention per se is dispersed in an aqueous medium only with difficulty. However, use of the substance produced by mixing a dispersion of the alkyl ammoniun salt of the present invention in an aqueous dispersion of clay, calcium carbonate, silica or the like and bentonite, makes the alkyl ammoniun salt usable in an aqueous medium.

Any clay, calcium carbonate, silica and bentonite are usable so long as they are of such a grade that is used for coating onto paper. A proportion of three components, i.e., (1) clay, calcium carbonate, silica, etc., (2) the bentonite and (3) the alkyl ammoniun salt, is generally 100:10 to 50:5 to 20 as the solid content. The component (3) may be used in an excess amount.

A ratio (by weight) of the condensation product of the aromatic aldehyde and the polyvalent alcohol of 5 or more valencies to the oil-absorbing white pigment used in the intermediate layer is at least 0.5 part of the condensation product based on 100 parts of the oil-absorbing white pigment. In this ratio, an effect of improving color formation can be recognized with a high heat energy. In particular, the ratio is preferabaly 1 to 20 parts. When the ratio is less than 0.5 part, the effect of improving color formation is very poor. With the ratio exceeding 20 parts, there is a tendency to reduce the effect of decreasing head stain.

A coating amount of the intermediate layer is generally in the range of 3 to 15 g/m$^2$, preferably 5 to 10 g/m$^2$, in view of head stain, color density, etc.

An amount of the amino acid compound to be used is not critical but it is preferred to coat the amino acid compound onto a support in a solid content of 0.05 to 5 g/m$^2$. A solid content of the N-acylamino acid compound of the present invention in the intermediate layer is preferably in the range of 0.5 to 50% by weight.

The intermediate layer provided in the present invention may also be incorporated with white pigments such as calcined kaolin, kaolin, natural silica, synthetic silica, aluminum hydroxide, calcium carbonate, calcium oxide, magnesium carbonate, magnesium oxide, urea-formalin filler, cellulose filler, etc. In general, white pigments showing an oil-absorbing amount of 50 ml/100 g or more as determined by JIS K5101 are advantageously used.

Examples of binders include styrene-butadiene rubber latex, acrylic resin emulsion, polyvinyl alcohol, carboxymethyl cellulose, hydroxyethyl cellulose, styrene-maleic anhydride copolymer, starch and derivatives thereof, casein, gelatin, etc. Other dispersing agents, defoaming agents, lubricants, etc. used in conventional coated paper may also be used.

In case that the oil-absorbing white pigment and the condensation product of aromatic aldehyde and polyvalent alcohol of 5 or more valencies are used in the present invention, it is desired to use binders. Specific examples of the binders include water soluble binders such as starch, starch derivatives, polyvinyl alcohol, carboxymethyl cellulose, hydroxymethyl cellulose, polyacrylamide, etc.; latex emulsion of hydrophobic polymers such as styrene-butadiene type, acrylic type, vinyl acetate type, etc.

The thermosensitive color-forming layer provided on the intermediate layer contains the color former and the color developer as the main components. If necessary and desired, wax, a sensitivity enhancer or sensitivity improving agent, metal soap, UV absorber, etc. may also be incorporated into the thermosensitive color-forming layer. The oil-absorbing pigment described above may also be incorporated in the thermosensitive color-forming layer.

Color formers used in the present invention are not particularly limited so long as they are generally used for pressure-sensitive recording paper or thermosensitive recording paper. Specific examples include the following color formers.

(1) Triarylmethane compounds:

3,3-bis(p-dimethylaminophenyl-6-dimethylaminophthalide (Crystal Violet Lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, etc.

(2) Diphenylmethane compounds:

4,4'-bis-dimethylaminophenyl benzhydryl benzyl ether, N-halophenyl leuco Auramine, N-2,4,5-trichlorophenyl leuco Auramine, etc.

(3) Xanthene compounds:

Rhodamine B anilinolactam, Rhodamine B p-nitroanilinolactam, Rhodamine B p-chloroanilinolactam, 3-diethylamino-7-dibenzylaminofluorane, 3-diethylamino-7-octylaminofluorane, 3-diethylamino-7-phenylfluorane, 3-diethylamino-7-chlorofluorane, 3-diethylamino-7-(3,4-dichloroanilino)fluorane, 3-diethylamino-7-(2-chloroanilino)fluorane, 3-diethylamino-6-methyl-7-anilinofluorane, 3-(piperidino)-6-methyl-7-anilinofluorane, 3-ethyltolylamino-7-anilinofluorane, 3-ethyltolylamino-6-methyl-7-phenethylfluorane, 3-diethylamino-7-(4-nitroanilino)fluorane, etc.

(4) Thiazine compounds:

benzoyl leuco methylene blue, p-nitrobenzoyl leuco methylene blue, etc.

(5) Spiro compounds:

3-methyl-spiro-dinaphthopyran, 3-ethyl-spirodinaphthopyran, 3,3'-dichloro-spiro-dinaphthopyran, 3-benzyl-spiro-dinaphthopyran, 3-methylnaphtho-(3-methoxybenzo)spiropyran, 3-propyl-spiro-benzopyran, etc.

These color formers can be used singly or as admixtures thereof. The color formers are chosen depending upon desired utility and property.

As dye developers used in the present invention, phenol derivatives and aromatic carboxylic acid derivatives are preferred. Among them, particularly preferred ones are bisphenol derivatives. Specific examples of the phenols are p-octylphenol, p-tert-butylphenol, p-phenylphenol, 1,1-bis(p-hydroxyphenyl)propane, 2,2-bis(p-hydroxyphenyl)propane, 1,1-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethylhexane, 2,2-bis(4-hydroxy-3,5-dichlorophenyl)propane, etc.

Examples of the aromatic carboxylic acid derivatives include p-hydroxybenzoic acid, ethyl p-hydroxybenzoate, 3,5-di-tert-butyl salicylate, 3,5-di-α-methylbenzyl salicylate, etc.; and polyvalent metal satls thereof, in the case of carboxylic acid derivatives.

As waxes, mention may be made of paraffin wax, carnauba wax, microcrystalline wax, polyethylene wax and, in addition thereto, higher fatty acid amides, for example, stearic amide, ethylenebisstearoamide, higher fatty acid esters, etc.

As metal soap, mention may be made of higher fatty acid polyvalent metal salts, i.e., zinc stearate, aluminum stearate, calcium stearate, zinc oleate, etc.

The sensitivity improving agents are those having a sharp melting point between 80° C. and 140° C. and having good thermal response. Specific examples are esters of benzoic acid or terephthalic acid, naphthalenesulfonic acid esters, naphthyl ether derivatives, anthryl ether derivatives, aliphatic ethers and other sensitizers such as phenanthrene, fluorene, etc. Said waxes can also be used as sensitizers.

These compounds are dispersed in binders and the resulting dispersion is coated. As the binders, water-soluble binders are general and exemplified by polyvinyl alcohol, hydroxyethyl cellulose, hydroxypropyl cellulose, ethylene-maleic anhydride copolymer, styrene-maleic anhydride copolymer, isobutylene-maleic anhydride copolymer, polyacrylic acid, starch derivatives, casein, gelatin, etc. Further for purposes of imparting moistureproofing property to these binders, moistureproofing agents (gelling agents, cross-linking agents) may be added or emulsions of hydrophobic polymers such as styrene-butadiene rubber latex, acrylic resin emulsions, etc. may also be added.

As devices used for coating the intermediate layer and thermosensitive layer, there may be used a coater head such as a blade coater, an air knife coater, a roll coater, a rod coater, a curtain coater, etc.

For purposes of further improving surface smoothness of the coated surface, devices of a machine calender, a supercalender, a gloss calender, brushing, etc. can be utilized.

A coating amount of the thermosensitive recording layer on the support is not critical but generally in the range of 3 to 15 g/m$^2$, preferably 4 to 10 g/m$^2$, on a dry basis.

For solvent resistance, etc. it is also possible to provide a protective layer on the thermosensitive layer.

By providing the substances as described above between the support and the thermosensitive recording layer, thermosensitive recording materials having a high sensitivity even with a low energy, minimized head stain and minimized reduction in density even when printed with a high energy can be obtained.

These effects are considered to be achieved because the components in the thermosensitive recording layer fused upon heating would be immediately absorbed and gelled owing to the oil-absorbing property possessed by these substances so that occurrence of head stain would be inhibited and permeation of an excessive melt product would be prevented to minimize a reduction in color density.

EXAMPLES

Next, the present invention will be described in more detail by referring to the examples.

Parts and % in the examples are all parts by weight and % by weight.

EXAMPLES 1 THROUGH 3

In 6000 g of water was dispersed 240 g of kaolin (ULTRA WHITE 90, trademark, manufactured by Engelhard) to make dispersion A and, 52 g of bentonite (BENGEL, trademark, manufactured by Japan Bentonite Co., Ltd.) was dispersed in 2600 g of water to make dispersion B. Furthermore, 28 g of dimethyldistearylammonium chloride was dispersed in 2800 g of hot water to make dispersion C.

Dispersion C was gently added to a mixture of dispersion A and dispersion B while stirring. After allowing to stand overnight, the supernatant was removed and only the precipitates were left. The precipitates were made D.

Calcined kaolin (manufactured by Georgia Kaolin Company, trademark ASTRAPAQUE, oil-absorbing amount of 70 ml/100 g when measured by JIS K5101) and D were dispersed in an aqueous sodium hexametaphosphate solution in ratios varied as shown in Table 1 to give 50% slurry. To the slurry was added 15 parts of 20% phosphated starch solution (manufactured by Japan Food Processing Industry Company, trademark MS4600) and 15 parts of latex (manufactured by Japan Synthetic Rubber Co., Ltd., trademark JSR 0692). The mixture was thoroughly mixed with each other. Furthermore, 15 parts of 2% carboxymethyl cellulose solution (manufactured by Dai-ichi Kogyo Seiyaku Co., Ltd., trademark CMC-WSC) was added to the mixture.

The resulting mixture was coated onto wood free paper having a weight of 50 g/m$^2$ in a solid content of 8 g/m$^2$ to give undercoat paper.

3-N,N-Diethylamino-6-methyl-7-phenylaminofluorane, 5 g, as a color former was dispersed in a ball mill together with 25 g of 5% polyvinyl alcohol (manufactured by Kuraray Co., Ltd., trademark PVA-105) to give a color former dispersion.

Bisphenol A, 10 g, as a color developer and 10 g of stearic amide as a sensitizer were mixed and the mixture was dispersed in a ball mill together with 100 g of 5% polyvinyl alcohol to give a dipsersion of the color developer and sensitizer.

In 40 g of 0.5% aqueous solution of sodium hexametaphosphate was dispersed 25 g of calcium carbonate (manufactured by Shiraishi Kogyo Co., Ltd., trademark Brt-15) as a pigment in a homogenizer to give a pigment dipsersion.

The color former dispersion, the dispersion of the color developer and the sensitizer and the pigment dispersion described above were mixed with each other and 5 g of 30% zinc stearate dispersion was added to the mixture to give a thermosensitive coating liquid. After the coating liquid was coated onto the aforesaid undercoat paper in a solid coverage of 5 g/m$^2$, supercalendering is performed to have a Bekk's degree of smoothness between 300 and 600 seconds. Thus samples were obtained.

Solid printing was made on each sample using a thermal printing test machine (THPMD) manufactured by Okura Electric Co., Ltd., under conditions of 2.0 msec in a printing cycle and 1.0 and 1.2 msec of pulse width.

EXAMPLES 4 and 5

Samples are prepared and evaluated in a manner similar to Examples 1 to 3 except that substance D containing dimethyldistearylammonium chloride of the present invention was omitted and dimethyldistearylammonium chloride was directly used in parts shown in Table 1. The results are shown in Table 1.

COMPARATIVE EXAMPLE 3

A sample was prepared and evaluated in a manner similar to Examples 1 to 3 except that substance D containing dimethyldistearylammonium chloride of the present invention was omitted and ULTRA WHITE manufactured by Engelhard is used instead of ASTRAPAQUE (calcined kaolin). The results are shown in Table 1.

TABLE 1

| Sample | Pigment (part) | Substance D (part) | Dimethyl-distearyl-Ammonium Chloride | Printing Density 0.8 msec | Printing Density 1.2 msec | Background Stain* |
|---|---|---|---|---|---|---|
| Example: | | | | | | |
| 1 | ASTRAPAQUE (90) | 10 | none | 1.26 | 1.27 | Δ |
| 2 | ASTRAPAQUE (80) | 20 | none | 1.28 | 1.29 | ○ |
| 3 | ASTRAPAQUE (60) | 40 | none | 1.26 | 1.26 | ○ |
| Comparative Example: | | | | | | |
| 1 | ASTRAPAQUE (100) | none | none | 1.26 | 1.27 | Δ |
| 2 | ANSILEX (100) | none | none | 1.28 | 1.22 | Δ |
| Example: | | | | | | |
| 4 | ASTRAPAQUE (100) | none | 1 | 1.30 | 1.30 | Δ |
| 5 | ASTRAPAQUE (100) | none | 2 | 1.32 | 1.31 | Δ |
| Comparative Example: | | | | | | |
| 3 | ULTRA WHITE 90 (100) | none | none | 1.06 | 1.08 | x |

*Evaluation of background stain:
○: very little stain
: a few stain
Δ : clearly observable stain
x : many stains Its recording density was measured with a reflection densitometer manufactured by Macbeth Company. At the same time, stain on the thermal head after printing was observed and background stain was evaluated by 4 stages of ○, Δ , Δ and x. The results are shown in Table 1.

COMPARATIVE EXAMPLE 1

A sample was prepared in a manner similar to Examples 1 to 3 except that substance D containing dimethyldistearylammonium chloride of the present invention was omitted from the pigment composition shown in Table 1. The results are shown in Table 1.

COMPARATIVE EXAMPLE 2

A sample was prepared and evaluated in a manner similar to Examples 1 to 3 except that substance D containing dimethyldistearylammonium chloride of the present invention was omitted and ANSILEX manufactured by Engelhard (oil-absorbing amount: 100 mg/100 g) was used as calcined kaolin instead of ASTRAPAQUE. The results were shown in Table 1.

EXAMPLE 6

| Dispersion A: | |
|---|---|
| Dibenzylidene sorbitol (manufactured by Shin-Nippon Rika Co., Ltd., trademark GELOL D) | 100 parts |
| 10% Sodium hexametaphosphate | 15 parts |
| Water | 285 parts |

The above composition was ground in a ball mill for 48 hours to prepare 25% dispersion of dibenzylidene sorbitol.

To 300 parts of water were added 10 parts of 10% sodium hexametaphosphate. After adding and dispersing 100 parts of synthetic silica (manufactured by Mizusawa Chemical Co., Ltd., trademark MIZUCASIL P-527, oil-absorbing amount: 160 ml/100 g) to and in the mixture, 4 parts of 25% dibenzylidene sorbitol dispersion A described above, 25 parts of 20% aqueous solution of oxidized starch (manufactured by Japan Food Processing Co., Ltd., trademark MS-3800) and 20.8 parts of 48% carboxylated styrene-butadiene latex (manufactured by Asahi Chemical Industry Co., Ltd., trademark DL-620) were added to and mixed with the dispersion to make a coating liquid for undercoat layer. The coating liquid was coated with an air knife coater onto wood free paper having a weight of 40 g/m$^2$ in a coverage of 5 g/m$^2$ (on dry weight solid basis) to give undercoat paper, which was then dried to give undercoat paper.

| | |
|---|---|
| Dispersion B: | |
| 3-Diethylamino-6-methyl-7-anilinofluorane | 100 parts |
| 5% Hydroxyethyl cellulose aqueous solution | 500 parts |
| Dispersion C: | |
| 4,4'-Isopropylidenediphenol | 100 parts |
| 5% Hydroxyethyl cellulose aqueous solution | |
| Dispersion D: | |
| 2-Benzyloxynaphthalene | 100 parts |
| 5% Hydroxyethyl cellulose aqueous solution | 500 parts |
| Dispersion E: | |
| Calcium carbonate | 100 parts |
| 5% Hydroxyethyl cellulose aqueous solution | 500 parts |

Dispersions B, C, D and E were independently dispersed in a ball mill for 72 hours and mixed in a weight ratio of B:C:D:E=1:5:3:2 to prepare a thermosensitive coating liquid. The thermosensitive coating liquid was coated with an air knife coater onto the aforesaid wood free paper provided with the undercoat layer in a coverage of 5 g/m$^2$ (on a dry weight solid basis). After drying at 60° C., supercalendering was performed to have a Bekk's smoothness degree between 300 and 500 seconds. Thus a thermosensitive recording sheet was obtained. Printing was performed on the thermosensitive recording sheet using thermosensitive printing test machine equipped with a thin layer head, manufactured by Matsushita Electronic Parts Co., Ltd., under conditions of a head voltage of 0.45 w/dot, 1 line recording time of 30 ms/l and a scanning line density of 8×3.85 dots/mm, by varying a pulse width to 0.8, 1.0, 1.2, 1.4, 1.5 and 2.0 msecs. Its printed density was measured with a Macbeth densitometer. Based on the measurement data for the color sensitivity and density and visual observation of foreign matters adhered to the thermal head (background stain), evaluation was made by ○, and x (○: very little stain,Δ: a few stain, x: many stains). These results are shown in Table 2.

EXAMPLE 7

A thermosensitive recording sheet was prepared and evaluated in a manner similar to Example 6 except that 25% dibenzylidene sorbitol dispersion A of Example 6 was increased to 20 parts and used as a coating liquid for undercoat layer.

EXAMPLE 8

A thermosensitive recording sheet was prepared and evaluated in a manner similar to Example 6 except that 25% dibenzylidene sorbitol dispersion A of Example 6 was increased to 40 parts and used as a coating liquid for undercoat layer.

EXAMPLE 9

| | |
|---|---|
| Dispersion F: | |
| Tribenzylidene sorbitol (manufactured by Shin-Nippon Rika Co., Ltd., trademark GELOL T) | 100 parts |
| 10% Sodium hexametaphosphate | 15 parts |
| Water | 285 parts |

The above composition was ground in a ball mill for 48 hours to prepare 25% dispersion of tribenzylidene sorbitol.

A thermosensitive recording sheet was prepared and evaluated in a manner similar to Example 6 except that 4 parts of 25% dibenzylidene sorbitol dispersion A of Example 6 were replaced by 20 parts of 25% tribenzylidene sorbitol dispersion F described above and used as a coating liquid for undercoat layer.

COMPARATIVE EXAMPLE 4

A thermosensitive recording sheet was prepared and evaluated in a manner similar to Example 6 except that 25% dibenzylidene sorbitol dispersion A of Example 6 was omitted and the remaining composition was used as a coating liquid for undercoat layer.

TABLE 2

| | Color Sensitivity and Density (pulse width, msec) | | | | | | Background |
|---|---|---|---|---|---|---|---|
| | 0.8 | 1.0 | 1.2 | 1.4 | 1.5 | 2.0 | Stain |
| Example: | | | | | | | |
| 6 | 0.50 | 0.69 | 0.98 | 1.20 | 1.26 | 1.33 | ○ |
| 7 | 0.51 | 0.68 | 0.98 | 1.21 | 1.27 | 1.36 | ○ |
| 8 | 0.53 | 0.70 | 0.99 | 1.21 | 1.27 | 1.36 | Δ |
| 9 | 0.50 | 0.68 | 0.97 | 1.21 | 1.28 | 1.34 | ○ |
| Comparative Example: | | | | | | | |
| 4 | 0.44 | 0.59 | 0.89 | 1.16 | 1.20 | 1.27 | x |

In Table 2, color sensitivity and density were evaluated by printing on the thermosensitive recording sheets using thermosensitive printing test machine equipped with a thin layer head, manufactured by Matsushita Electronic Parts Co., Ltd., under conditions of a head voltage of 0.45 w/dot, 1 line recording time of 30 ms/l and a scanning line density of 8×3.85 dots/mm, by varying a pulse width to 0.8, 1.0, 1.2, 1.4, 1.5 and 2.0 msecs and measuring printed density with a Macbeth densitometer. Based on the measurement data for the color sensitivity and density and visual observation of foreign matters adhered to the thermal head (background stain), evaluation was made by ○Δand x (○: very little stain,Δ: a few stain, x: many stains).

EXAMPLES 10 THROUGH 12

Calcined kaolin (manufactured by Georgia Kaolin Company, trademark ASTRAPAQUE, oil-absorbing amount of 72 ml/100 g), 100 parts, and the amino acid compound (GP-1, trademark manufactured by Ajinomoto Co., Inc.) of the present invention were dispersed in an aqueous sodium hexametaphosphate solution in ratios varied as shown in Table 3 to give 50% slurry. To the slurry was added 15 parts of 20% phosphated starch solution (manufactured by Japan Food Processing Industry Company, trademark MS4600) and 15 parts of latex (manufactured by Japan Synthetic Rubber Co., Ltd., trademark JSR 0692). The mixture was thoroughly mixed with each other. Furthermore, 15 parts of 2% carboxymethyl cellulose solution (manufactured by Dai-ichi Kogyo Seiyaku Co., Ltd., trademark CMC-WSC) was added to the mixture.

The resulting mixture is coated onto wood free paper having a weight of 50 g/m$^2$ in a solid content of 8 g/m$^2$ to give undercoat paper.

3-N,N-Diethylamino-6-methyl-7-phenylaminofluorane, 5 g, as a color former is dispersed in a ball mill together with 25 g of 5% polyvinyl alcohol (manufactured by Kuraray Co., Ltd., trademark PVA-105) to give a color former dispersion.

Bisphenol A, 10 g, as a color developer and 10 g of stearic amide as a sensitizer were mixed and the mixture was dispersed in a ball mill together with 100 g of 5% polyvinyl alcohol to give a dipsersion of the color developer and sensitizer.

In 40 g of 0.5% aqueous solution of sodium hexametaphosphate was dispersed 25 g of calcium carbonate (manufactured by Shiraishi Kogyo Co., Ltd., trademark Brt-15) as a pigment in a homogenizer to give a pigment dipsersion.

The color former dispersion, the dispersion of the color developer and the sensitizer and the pigment dispersion described above were mixed with each other and 5 g of 30% zinc stearate dispersion was added to the mixture to give a thermosensitive coating liquid. After the coating liquid was coated onto the aforesaid undercoat paper in a solid coverage of 5 g/m$^2$, supercalendering was performed to have a Bekk's degree of smoothness between 300 and 600 seconds. Thus samples were obtained.

Solid printing was made on each sample using a thermal printing test machine (THPMD) manufactured by Okura Electric Co., Ltd., under conditions of 2.0 msec in a printing cycle and 0.8 and 1.2 msec of pulse width. Its recording density was measured with a reflection densitometer manufactured by Macbeth Company. At the same time, stain on the thermal head after printing was observed and background stain was evaluated by 4 stages of ∘, Δ , Δ and x. The results are shown in Table 3.

COMPARATIVE EXAMPLE 5

A sample was prepared in a manner similar to Examples 10 to 12 except that the amino acid compound of the present invention was omitted from the pigment composition shown in Table 3. The results are shown in Table 3.

COMPARATIVE EXAMPLE 6

A sample was prepared and evaluated in a manner similar to Examples 10 to 12 except that the amino acid compound of the present invention was omitted, ANSILEX manufactured by Engelhard (oil-absorbing amount: 100 ml/100 g) was used as calcined kaolin and carboxymethyl cellulose was omitted. The results are shown in Table 3.

COMPARATIVE EXAMPLE 7

A sample was prepared and evaluated in a manner similar to Examples 10 to 12 except that the amino acid compound of the present invention was omitted and HYDRA SPERSE (oil-absorbing amount: 48 ml/100 g) manufactured by Huber was used as calcined kaolin. The results are shown in Table 3.

TABLE 3

| Sample | Pigment (part) | Amino Acid Compound | Printing Density 0.8 msec | Printing Density 1.2 msec | Background Stain* |
|---|---|---|---|---|---|
| Example: | | | | | |
| 10 | ASTRAPAQUE (100) | 1 | 1.26 | 1.26 | Δ |
| 11 | ASTRAPAQUE (100) | 2 | 1.29 | 1.28 | ∘ |
| 12 | ASTRAPAQUE (100) | 5 | 1.28 | 1.27 | ∘ |
| Comparative Example: | | | | | |
| 5 | ASTRAPAQUE (100) | none | 1.26 | 1.27 | Δ |
| 6 | ANSILEX (100) | none | 1.28 | 1.22 | Δ |
| 7 | HYDRA SPERSE 90 (100) | none | 1.06 | 1.08 | x |

*Evaluation of background stain:
∘: very little stain
Δ : a few stain
Δ : clearly observable stain
x : many stains From the results shown in Tables 1 through 3, it is clearly noted that the thermosensitive recording materials of the present invention provide a high color density at any pinting energy and minimized generation of foreign matters.

While the invention has been described in detail and with reference to specific embodiments thereof, it is apparent to one skilled in the art that various changes and modifications can be made therein without departing from the spirit and the scope of the present invention.

What is claimed is:

1. A thermosensitive recording material comprising a support having provided thereon a thermosensitive recording layer comprising a substantially colorless or light-colored electron donating dye precursor and an electron accepting compound and an intermediate layer having provided between said support and said thermosensitive recording layer, said intermediate layer containing at least one material selected from the group consisting of:

a compound represented by general formula [I] below, or a substance produced from (1) at least one of clay, calcium carbonate and silica, (2) a bentonite pigment and (3) an alkyl ammonium salt represented by general formula [I], a combination of an oil-absorbing white pigment with a condensation product of an aromatic aldehyde and a polyvalent alcohol of at least 5 valencies, and, an N-acylamino acid compound, wherein formula [I] is represented by:

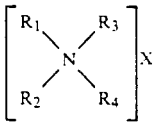

[I]

wherein each of $R_1$, $R_2$, $R_3$ and $R_4$ independently represents hydrogen or an alkyl group, provided that the sum of carbon atoms for $R_1$ to $R_4$ is at least 14; and X represents an anionic atom or atomic group.

2. A thermosensitive recording material of claim 1, wherein said intermediate layer contains said alkyl ammonium salt in a coverage of 0.05 to 6 g/m$^2$ as a solid content.

3. A thermosensitive recording material of claim 1, wherein said intermediate layer contains the combination of said oil-absorbing white pigment and the condensation product of an aromatic aldehyde and a polyvalent alcohol of at least 5 valencies in a coverage of 3 to 15 g/m$^2$.

4. A thermosensitive recording material of claim 1, wherein said intermediate layer contains said N-acylamino acid compound in an amount of 0.5 to 50% by weight.

5. A thermosensitive recording material as in claim 1 wherein said intermediate layer contains said substance which has been prepared by adding an aqueous dispersion of a compound represented by the general formula [I] to an aqueous dispersion containing at least one material selected from clay, calcium carbonate and silica, and bentonite pigment.

6. A thermosensitive recording material as in claim 5, wherein said substance is one material produced by mixing (1) at least one selected from clay, calcium carbonate and silica, (2) bentonite pigment, and (3) said compound in a ratio (1):(2):(3) of 100:10 to 50:5 to 20.

* * * * *